US006220828B1

(12) United States Patent
Lau

(10) Patent No.: US 6,220,828 B1
(45) Date of Patent: Apr. 24, 2001

(54) APPARATUS FOR INTRODUCING AIR AND WATER

(75) Inventor: Kwok-Wing Lau, Hong Kong (HK)

(73) Assignee: Pleasure Time Products (HK) Limited, Kowlon Bay (HK)

( * ) Notice: Subject to any disclaimer, the term of this patent is extended or adjusted under 35 U.S.C. 154(b) by 0 days.

(21) Appl. No.: 09/490,403

(22) Filed: Jan. 24, 2000

(51) Int. Cl.[7] ..... F04B 17/00; F04B 35/00
(52) U.S. Cl. ..... 417/405; 4/492
(58) Field of Search ..... 52/214; 15/330; 4/492, 541.6; 417/405, 407, 313

(56) References Cited

U.S. PATENT DOCUMENTS 3,810,262 * 5/1974 Strand ..... 52/2.14
4,114,230 * 9/1978 MacFarland ..... 15/330
4,773,104 * 9/1988 Wang ..... 4/492
5,145,333 * 9/1992 Smith ..... 417/405
5,340,286 * 8/1994 Kanigowski ..... 417/407
5,618,166 * 4/1997 Legett et al. ..... 417/313
6,065,161 * 5/2000 Mateina et al. ..... 4/541.6

* cited by examiner

*Primary Examiner*—Teresa Walberg
*Assistant Examiner*—L Fastovsky
(74) *Attorney, Agent, or Firm*—Raymond Sun

(57) ABSTRACT

An apparatus has a first chamber having a water inlet for receiving a flow of water, a water outlet, and a rotating device that is rotated by the flow of water. The apparatus also includes a second chamber having an air inlet, an air outlet, and an air generator coupled to the rotating device for generating air when the rotating device is rotated. The water in the first chamber is directed to fill the pool or object, while the generated air is provided via the air outlet to inflate the pool or object.

10 Claims, 3 Drawing Sheets

APPARATUS FOR INTRODUCING AIR AND WATER

BACKGROUND OF THE INVENTION

1. Field of the Invention

The present invention relates to portable and outdoor equipment, and in particular, to an apparatus that pumps water and air to an inflatable pool or object.

2. Description of the Prior Art

Swimming pools provide much amusement and recreation to adults and children alike, especially during hot weather. In particular, children enjoy playing in splash pools, swimming pools, ponds, streams, beaches and other places where they can play and amuse themselves in cool and refreshing water.

Portable pools are especially popular because they are lightweight and can be conveniently carried from one location to another. One type of these portable pools is inflatable, in which the side walls of the pool are provided in a double-walled configuration to define an internal chamber into which air is introduced and stored. Introducing the air into the internal chamber inflates the side wall for use. Water can then be added into the pool for use. These inflatable pools can then be deflated prior to folding and collapsing.

Unfortunately, it can be very inconvenient and time consuming to deploy these inflatable pools for use. In particular, the user must first pump air into the internal chamber to inflate the side wall. After the side walls have been inflated, water must be introduced to the pool. These two steps are separate and can be very time-consuming. Another inconvenience is that the user must carry a separate air pump to inflate the pool.

Thus, there remains a need for an apparatus that will minimize the time and tools needed to deploy an inflatable pool or object.

SUMMARY OF THE DISCLOSURE

It is an objective of the present invention to provide an apparatus that minimizes the time and tools needed to deploy an inflatable pool or object.

It is another objective of the present invention to provide an apparatus that can simultaneously inflate an inflatable pool or object and to add water to the inflatable pool or object.

It is yet another objective of the present invention to provide an apparatus which uses the flow of water to generate air for inflating the inflatable pool or object.

The objectives of the present invention are accomplished by providing an apparatus having a first chamber having a water inlet for receiving a flow of water, a water outlet, and a rotating device that is rotated by the flow of water. The apparatus also includes a second chamber having an air inlet, an air outlet, and an air generator coupled to the rotating device for generating air when the rotating device is rotated. The water in the first chamber is directed to fill the pool or object, while the generated air is provided via the air outlet to inflate the pool or object.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides an apparatus that simultaneously introduces air and water to an inflatable pool or other inflatable object. The apparatus uses the flow of water to rotate or power a rotating device whose rotation causes an air generator to generate air that is used to inflate the inflatable pool. Although the following description shall be made in connection with an inflatable pool, the apparatus of the present invention can also be used with any other device or object that requires both air and water to be delivered or introduced.

Figure 1:
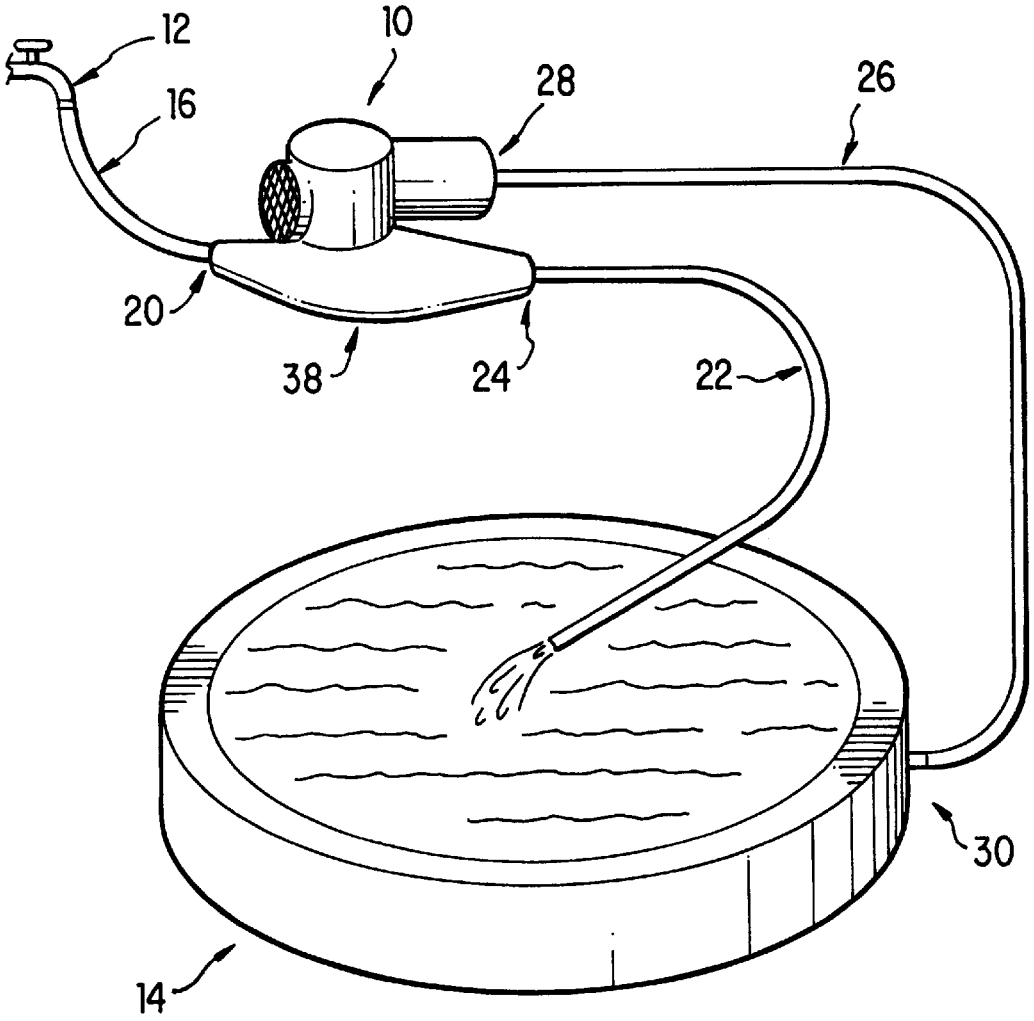
FIG. 1 is a perspective view of an apparatus for introducing air and water according to one embodiment of the present invention shown in use with a portable inflatable pool.

As shown in FIG. 1, the apparatus 10 according to the present invention can be coupled between a water outlet 12 and an inflatable pool 14. A water hose or tubing 16 couples the water outlet 12 to a water inlet 20 of the apparatus 10, and a first tubing 22 couples a water outlet 24 of the apparatus 10 to the interior of the pool 14. A second tubing 26 couples an air outlet 28 of the apparatus 10 to a conventional air inlet 30 in the side wall of the pool 14.

Figure 2:
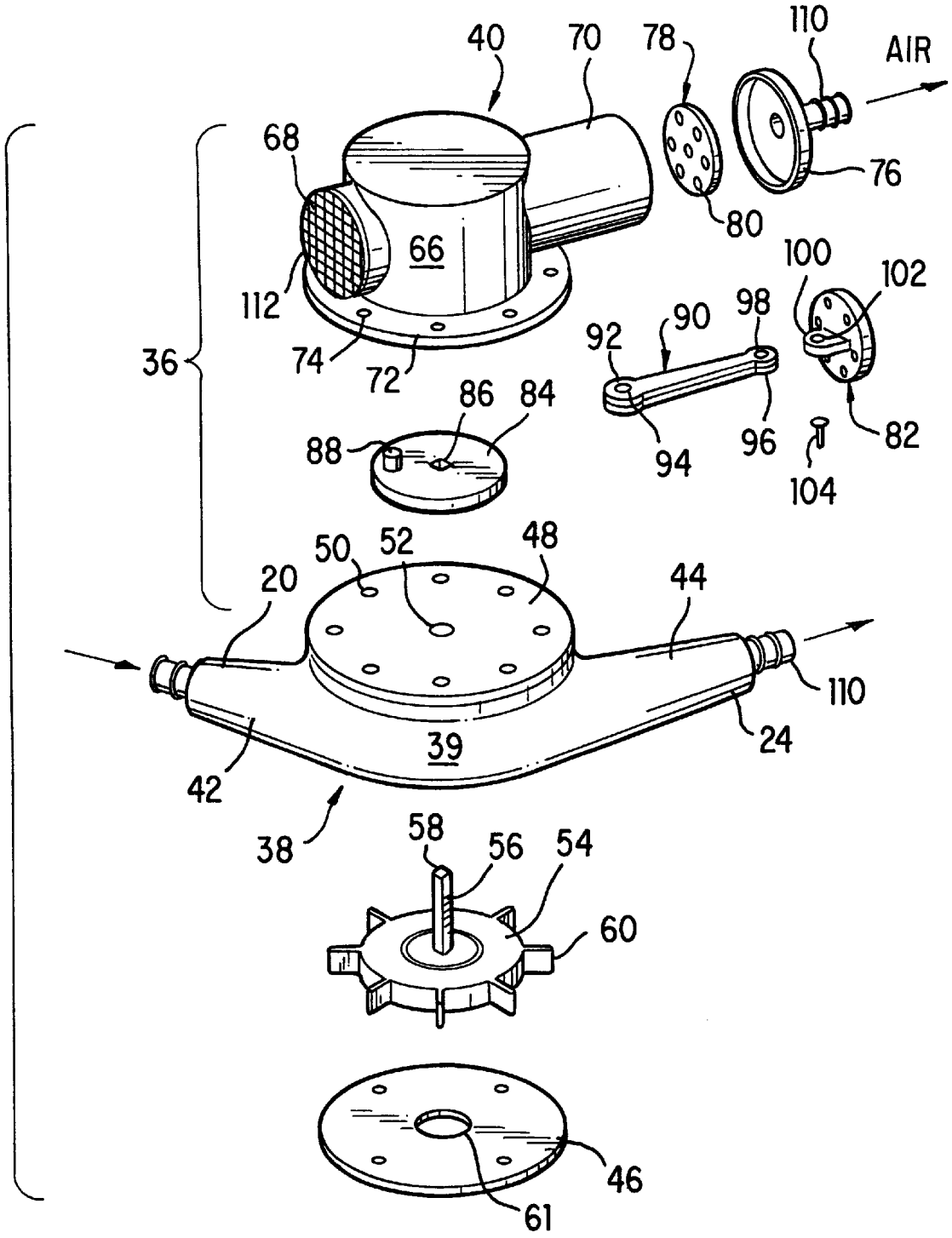
FIG. 2 is an exploded perspective view of the apparatus of FIG. 1.
Figure 3:
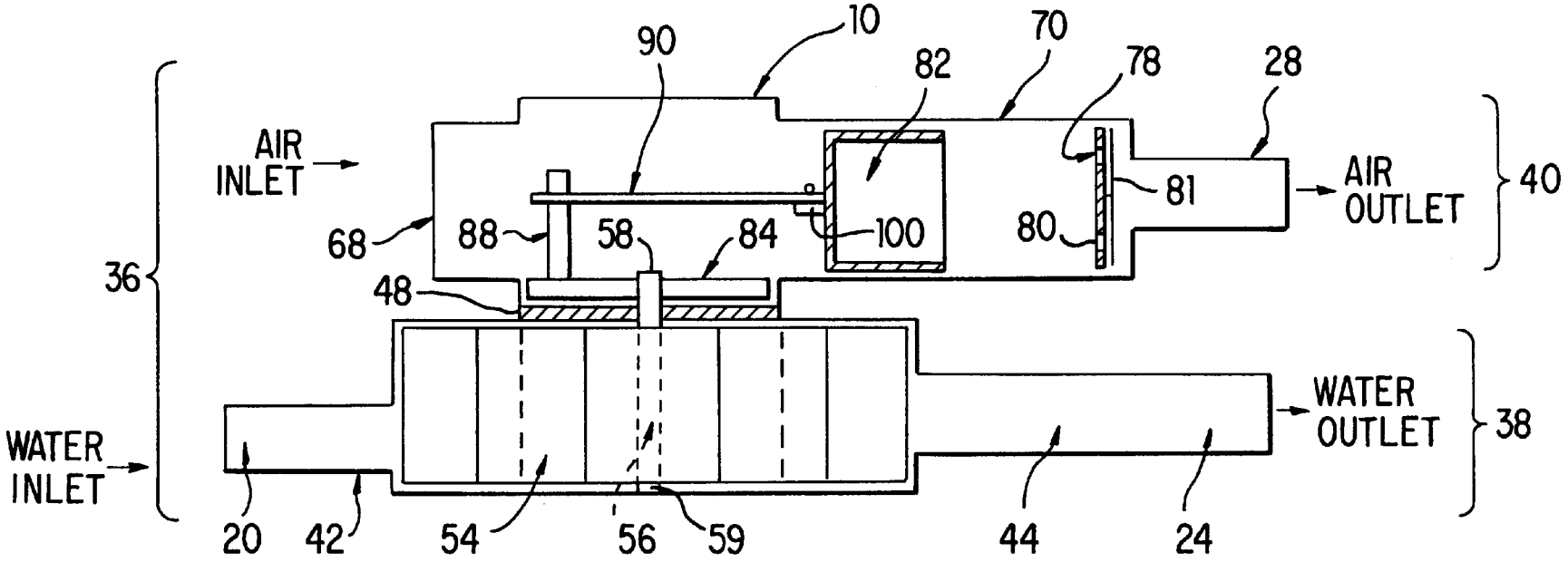
FIG. 3 is a cross-sectional view of the apparatus of FIG. 1.

An apparatus 10 according to the present invention is illustrated in connection with FIGS. 2 and 3. The apparatus 10 has a main housing 36 that has a first or lower housing 38 and a second or upper housing 40. The first housing 38 has a generally circular or rounded body 39 that defines a first chamber, and has first and second cylindrical extensions 42 and 44 that lead to a water inlet 20 and a water outlet 24, respectively. The first housing 38 also has a bottom plate 46 and a top plate 48, both of which can be riveted, screwed (e.g., see screws or rivets 50) or otherwise connected to the first housing 38. The top plate 48 also has a central opening 52. A rotating device, such as a flywheel 54, is retained inside the first housing 38, and is supported for rotation therein by a four-sided shaft 56. The shaft 56 has an upper end 58 that extends through the opening 52 of the top plate 48, and a lower end 59 that extends through an opening 61 in the bottom plate 46. The flywheel 54 has a plurality of fins 60 that are provided in spaced-apart manner about the outer surface of the flywheel 54. These fins 60 act as paddles to direct water from the water inlet 20 towards the water outlet 24 when the flywheel 54 is rotated.

The second housing 40 has a generally circular body 66 that defines a second chamber. The second housing 40 has an air inlet 68, and a cylindrical extension 70 that leads to the air outlet 28. A flange 72 extends from the bottom of the body 66, and has screw or rivet openings 74 that are adapted to allow the flange 72 to be connected to the top plate 48 via the screws or rivets 50, so as to connect the first and second housings 38 and 40. The air outlet 28 has a cover 76, and a generally circular plate 78 can be fitted inside the cover 76 at the air outlet 28. The plate 78 has a plurality of openings 80, and a flexible plastic piece 81 is connected to the plate 78 and positioned between the plate 78 and the cover 76. The plate 78 and plastic piece 81 together function to prevent the backflow of air. For example, air from the second housing 40 can pass through the openings 80 of the plate 78 and push the flexible plastic piece 81 away from the plate 78 so that the air can travel to the air outlet 28. However, backflow of air is prevented because the back-flowing air will push the plastic piece 81 against the plate 78 to create a seal.

The second housing 40 houses an air generator, which includes a piston 82 that is retained for reciprocal movement inside the cylindrical extension 70. In addition, a cam plate 84 is retained inside the body 66, and has a four-sided opening 86 that is adapted to match the four-sided configuration of the shaft 56 to achieve a locking engagement of the shaft 56 inside the opening 86. The cam plate 84 also has a vertical rounded extension 88 provided in an off-center location on the cam plate 84. A crank 90 has a first end 92 that has a rounded opening 94 for receiving the rounded extension 88 of the cam plate 84, and a second end 96 that is connected to the piston 82. This connection can be accomplished by providing the second end 96 with an opening 98, providing the piston 82 with an extension 100 having an opening 102, and extending a screw 104 through the openings 98 and 102. Thus, when the shaft 56 extends through the opening 86 of the cam plate 84, the cam plate 84 will rotate when the flywheel 54 and the shaft 56 rotate. The crank 90 couples the piston 82 to the cam plate 84 to reciprocate the piston 82 when the cam plate 84 rotates.

The water inlet 20 and the outlets 24 and 28 can be provided with threads 110 to provide friction for facilitating the engagement of the tubings 16, 22 and 26. In addition, the air inlet 68 can be provided with a meshed cover 112 to prevent dirt and unwanted particles from entering the second housing 40.

The operation and use of the apparatus 10 will now be described. First, the user connects the tubings 16, 22 and 26 in the manner shown in FIG. 1 and described above. The user then turns on the water, so that water flows via the hose 16 through the water inlet 20 and into the first housing 38. The water inflow will cause the flywheel 54 to rotate, with the fins 60 paddling or directing the water to the water outlet 24, and then via the tubing 22 to fill the pool 14. At the same time, rotation of the flywheel 54 will cause the shaft 56 to rotate. The locking engagement of the shaft 56 in the opening 86 of the cam plate 84 will also cause the cam plate 84 to rotate. Rotation of the cam plate 84 will cause the crank 90 to be reciprocated back and forth inside the second housing 40 because of the coupling of the crank 90 to an off-centered location (i.e., the extension 88) of the cam plate 84, which simultaneously reciprocates the piston 82 back and forth inside the cylindrical extension 70. The reciprocating movement of the piston 82 will push air that has entered the second housing 40 from the air inlet 68 out of the air outlet 28 and via tubing 26 to inflate the pool 14.

Thus, the apparatus 10 of the present invention utilizes the flow of water to simultaneously pump water and air to the pool 14. By combining these two important operations, the apparatus 10 greatly simplifies the deployment of a portable inflatable pool 14, thereby making it more convenient and faster for a user to deploy the pool 14 for use.

While the description above refers to particular embodiments of the present invention, it will be understood that many modifications may be made without departing from the spirit thereof. The accompanying claims are intended to cover such modifications as would fall within the true scope and spirit of the present invention. For example, although the housing 40 has been referred to as an upper housing and the housing 38 as a lower housing, these housings 38 and 40 can be interchanged, or provided in a side-by-side manner.

What is claimed is:

1. An apparatus, comprising:

a first chamber having a water inlet for receiving a flow of water, a water outlet, and a rotating device that is rotated by the flow of water; and a second chamber having an air inlet, an air outlet, and an air generator coupled to the rotating device for generating air when the rotating device is rotated.

2. The apparatus of claim 1, wherein the rotating device includes a flywheel.

3. The apparatus of claim 1, wherein the air generator includes a piston.

4. The apparatus of claim 3, wherein the air generator further includes a crank having a first end coupled to the rotating device, and a second end coupled to the piston.

5. The apparatus of claim 4, further including a shaft coupling the first end of the crank and the rotating device.

6. The apparatus of claim 5, wherein the air generator further includes a cam plate having an opening for receiving the shaft, and an extension for coupling the first end of the crank.

7. The apparatus of claim 6, wherein the extension is positioned in an off-center location on the cam plate.

8. The apparatus of claim 2, further including a shaft for coupling the flywheel to the air generator.

9. A method of deploying an inflatable pool, comprising:

providing a flow of water to a first chamber to rotate a rotating device;

coupling the rotating device to an air generator;

generating a stream of air from the air generator upon rotation of the rotating device;

providing the stream of air to inflate the pool; and directing the flow of water out of an outlet of the first housing to fill the pool.

10. The method of claim 9, further including: providing a second chamber for housing the air generator.

* * * * *